United States Patent [19]

Naff, Jr.

[11] Patent Number: 4,655,495

[45] Date of Patent: Apr. 7, 1987

[54] LITTER GUN

[76] Inventor: Wesley W. Naff, Jr., Rte. 1, Box 204, Boones Mill, Va. 24065

[21] Appl. No.: 889,706

[22] Filed: Jul. 28, 1986

[51] Int. Cl.[4] ..... B08B 1/00

[52] U.S. Cl. ..... 294/61; 294/19.1

[58] Field of Search ..... 294/61, 19.1, 50, 50.5, 294/50.6, 110.1, 24, 2, 10, 14, 33

[56] References Cited

U.S. PATENT DOCUMENTS

| | | | |
|---|---|---|---|
| 2,642,306 | 6/1953 | Beeler | 294/61 |
| 2,732,242 | 1/1956 | Belford | 294/61 |
| 2,804,336 | 8/1957 | Thompson | 294/61 |
| 3,183,031 | 5/1965 | Haberstick | 294/19 |
| 3,873,143 | 3/1975 | Foust | 294/61 |
| 4,502,722 | 3/1985 | Rocquin | 294/61 |

*Primary Examiner*—James B. Marbert

*Attorney, Agent, or Firm*—Griffin, Branigan and Butler

[57] ABSTRACT

A litter gun (10) includes a handle (12) with an elongated spear (14), surrounded by a longitudinally movable tubularly-shaped barrel (16), fixedly attached thereto. A biasing spring (18) mounted between the handle and the barrel biases the barrel outwardly. A trigger (20) is mounted in the handle for engaging a graduated ratchet mechanism of the barrel at various points therealong to hold the barrel and prevent outward longitudinal movement thereof. As an operator drives the spear into trash the barrel is urged backwardly into the handle to compress the biasing spring and it is held in these positions by the trigger mechanism. Actuation of the trigger mechanism releases the barrel to drive forwardly, shooting the trash from the end of the spear into a receptacle.

6 Claims, 4 Drawing Figures

LITTER GUN

BACKGROUND OF THE INVENTION

This invention relates generally to the art of trash collectors, and more specifically, to spear type trash collectors.

Most people have at one time or another employed a stick with a cut-off nail therein to pick up trash, the nail at one end of the stick being controlled from the other end to penetrate trash. The trash is then shoved from the nail by an operator's hand into a trash receptacle. This device is relatively messy and slow to use and requires the use of two hands. It is an object of this invention to provide a spear-type device for picking up trash which can be operated by one hand and which is relatively clean and fast in operation.

A number of devices manifesting improvements in the "nail-in-the-stick" trash collector have been suggested over the years and some of them have been put into practice. For example, U.S. Pat. No. 3,183,031 to Haberstick describes a paper and rubish pick-up in which a rod passes through a stationary tubing and is interconnected therewith by a spring. When a handle member is pressed, a point of the rod comes out of the tubing to penetrate paper on the ground. When the handle member is released the spring will pull the rod back into the tubing and the paper or rubish will be dropped into a receptacle. A problem with this device is that an operator thereof must exert continual pressure on the handle member once he has penetrated one piece of trash, otherwise the trash will be prematurely disengaged onto the ground. Thus, it is an object of this invention to provide a litter gun which is automatically cocked upon penetration of a piece of trash but which must not be held in the cocked position by exertion of force.

U.S. Pat. No. 2,642,306 to Beeler discloses a device in which a trigger engages a groove of a spear. After an exposed end of the spear has been filled with trash it is placed in a trash receptacle and a handle of the trigger is pressed to disengage the groove. When this occurs, a loaded spring will force the spear rod upwardly relative to a housing to cause trash on the spear point to disengage the point. The spear point is returned to its operative position by moving the spear rod downwardly in the housing until the trigger again engages the groove. This device must be "cocked" before it can be used and such cocking requires the use to two hands. It is an object of this invention to provide a litter gun which must not be cocked prior to use and which can be easily operated by one hand.

U.S. Pat. No. 2,804,336 to Thompson includes a hand grip to move a rod in a tube. Downward movement of the rod causes a plate to move away from a head and thereby eject trash from prongs. Again, this device requires two hands to operate.

Foust (U.S. Pat. No. 3,873,143) discloses a device which can be operated by one hand, however, the handle of this device is rather difficult to manipulate and this device can only function in relatively deep, soft soil, or it must be designed to pick up only small amounts of trash. It is an object of this invention to provide a litter spear device which can easily be manipulated by one hand to pick up both small and large amounts of trash in areas of shallow soft soil as well as areas of deep soft soil.

It is an object of this invention to provide a litter gun which not only can be operated with one hand to pick up large amounts of trash in areas of shallow soft soil, but also which "shoots" litter, pistol style, short distances when the litter is ejected thereby increasing the range of an operator and providing fun and satisfaction for the operator during operation of the litter gun.

It is a further object of this invention to provide such a litter gun which is relatively inexpensive to construct and uncomplicated to use.

SUMMARY

According to principles of this invention, a spear is fixedly attached to a pistol-type handle and has a tubularly-shaped barrel surrounding it. The barrel is longitudinally slidable within the handle, but is biased by a spring in the handle so that its outer end is at or beyond an outer end of the spear. A trigger in the handle engages a graduated ratchet mechanism on the barrel for preventing its outward longitudinal movement. The litter gun is manipulated by the pistol-type handle so that its spear is driven through pieces of trash and as this is done the trash forces the barrel into the handle where it is held by engagement between the trigger and ratchet mechanisms. Pieces of trash are shot from the litter gun by actuating the trigger to release the barrel, thereby allowing the biasing spring to sharply shove the trash toward the end of the spear, shooting the trash from the spear.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figures 1, 2, 3, 4:
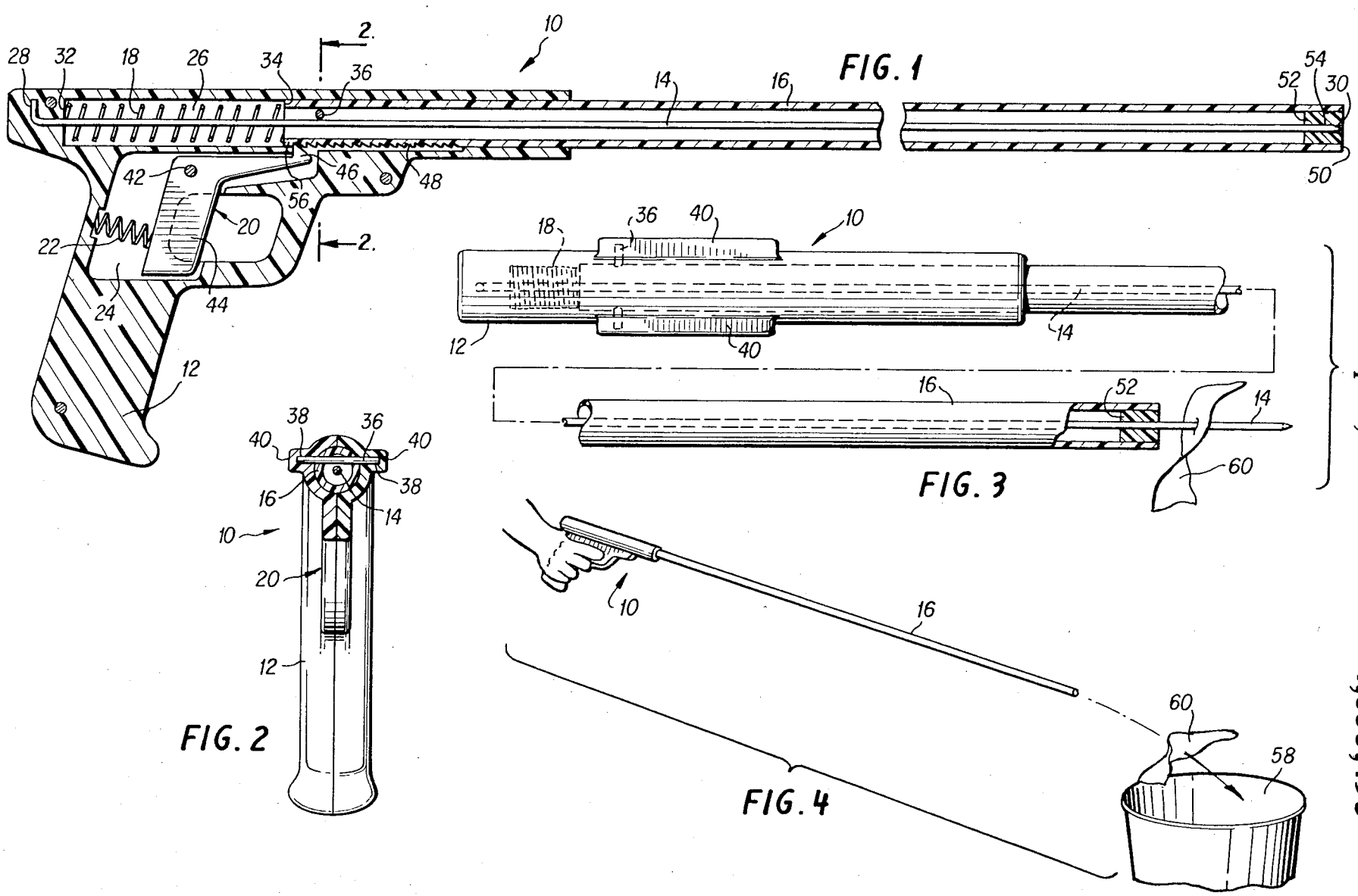
FIG. 1 is a partially sectional side view of a litter gun of this invention in an extended configuration with no litter thereon.
FIG. 2 is a front sectional view taken on line 2—2 in FIG. 1.
FIG. 3 is a top view of the litter gun of FIG. 1 with a barrel thereof being retracted and litter being engaged with a spear thereof; and, FIG. 4 is an isometric view of trash being shot into a receptacle by the litter gun of FIG. 1.

A litter gun 10 comprises a hard plastic handle 12, a spear 14, a barrel 16, a barrel spring 18, a trigger mechanism 20, and a trigger spring 22.

The hard plastic handle 12 forms a pistol-grip-shaped housing having a trigger cavity 24 which communicates with a barrel cavity 26 at its upper end. The plastic handle 12 is made of two opposite and equal parts which are adhered together, with only one half being shown in FIG. 1 and being indicated as being cut in cross section. In this respect, it is possible to make the plastic handle 12 of one integral plastic part with only a cover covering the trigger cavity 24 to allow access to the trigger mechanism 20.

The spear 14 is constructed of steel and is anchored at its rear end 28 in a rear portion of the plastic handle 12.

The spear 14 is a $\frac{1}{8}$ inch diameter welding rod whose outer end 30 is slightly pointed and whose rear end 28 is bent to securely engage it with the plastic handle 12. In the preferred embodiment, the length of the rod is around $29\frac{1}{4}$ inches.

The barrel 16 is a $\frac{1}{2}$ inch plastic (PVC) pipe having a 0.480 internal diameter, a 0.620 outer diameter, and a 26 inch length. This pipe fits easily into the barrel cavity 26 of the plastic handle 12 and is longitudinally slidable therein. In this regard, the barrel cavity 26 is cylindrically shaped to be only slightly larger than the outer diameter of the barrel 16 so that it provides rigid lateral support for the barrel 16, however, it allows the barrel to move freely in a linear, axial, direction. The barrel spring 18 is mounted in the barrel cavity 26 and is loaded to expand between a rear end 32 of the barrel cavity 26 and the rear end 34 of the barrel 16, thereby urging the barrel 16 outwardly. A stop pin 36 extends through the barrel and into guide cavities 38 of guide tracks 40 (FIGS. 2 and 3) molded in the handle 12. The stop pin 36 has a $\frac{1}{8}$ inch diameter and is $\frac{7}{8}$ inches long. The guide tracks 40 and the stop pin 36 allow approximately $2\frac{1}{8}$ inch longitudinal movement of the barrel 16 in the handle 12. In addition, the stop pin 36 and the guide tracks 40 keep the barrel 16 in one specific angular attitude, that is, they do not allow the barrel to rotate about its axis. It should be noted that the stop pin 36 does not pass through the center of the barrel 16 because if it did it would impinge on the spear 14 to thereby inhibit linear relative movement between the barrel 16 and the spear 14.

The trigger mechanism 20 is pivotably mounted on a trigger pin 42 which is mounted at its opposite ends in members forming the plastic handle 12. The trigger spring 22 is mounted between a wall defining the trigger cavity 24 and the rear of a finger grip portion 44 of the trigger mechanism 20 to urge the trigger mechanism 20 to rotate in a counter-clockwise direction as viewed in FIG. 1. In this respect, the trigger mechanism 20 includes a pawl member 46 for engaging teeth 48 of a ratchet mechanism cut on the lower side of the barrel 16 near its rear end 34. In this respect, when the barrel 16 is in its forwardly most position, its outer end 50 is at or slightly beyond the outer end 30 of the spear 14. A plastic grommet 52 is fixedly attached to the inner surface of the barrel 16 at its outer end 50 and has a central bore 54 for slidably guiding the spear 14 within the center of the barrel 16. Additional grommets can be located in the barrel 16 as is shown in FIG. 1. In any event, when the barrel is in this fully extended position, as shown in FIG. 1, the pawl member 46 of the trigger mechanism 20 engages the last tooth 56 of the barrel's ratchet mechanism. It can be seen in FIG. 1 that the teeth 48 have beveled, ramp-like, edges facing the rear end 34 of the barrel 16 and radial, vertical, edges facing the outer end 50 of the barrel 16. Similarly, the pawl member 46 has a beveled, ramp-like, edge facing the outer end 50 of the barrel and a radial, vertical, edge facing the rear end 34 of the barrel. Thus, the barrel 16 is allowed to move into the barrel cavity 26 by the engaging ramps, thereby further biasing the barrel spring 18, however, interaction between vertical edges of the pawl member 46 and the teeth 48 prevent the barrel from thereafter moving outwardly.

Describing now operation of the litter gun 10, when one begins to use the litter gun the barrel 16 is in its extended position as shown in FIG. 1. An operator grips the plastic handle 12 in the manner of gripping a pistol, with his index finger extended about the finger-grip portion 44 of the trigger mechanism 20 without exerting a force thereon. Upon seeing trash located on the ground, the operator manipulates the litter gun 10 so that outer ends 30 and 50, respectively, of the spear 14 and the barrel 16 press the trash against the ground. The trash and ground urge the barrel 16 back into the barrel cavity 26 of the handle 12, thereby further biasing the barrel spring 18 while the spear 14 pierces the trash and extends into the ground under the trash. The barrel is held in this new, retracted position by the trigger pawl member 46 and an appropriate tooth 48. In this respect, since the ratchet mechanism is so finely graduated with many teeth 48 the barrel does not have to be pushed back very far by trash being speared, in order to "cock" the barrel 16. Thus, the litter gun can function in very shallow soft soil or even with thick trash on cement. At the same time the litter gun can be used for large amounts of trash. In any event, the litter gun 10 is automatically "cocked" by the action of piercing trash with the spear 14. It should be noted that the operator accomplished this with one hand. The operator can go about thusly spearing trash and further cocking the barrel as is necessary to retain additional trash on the spear 14. Eventually, the stop pin 36 and guide tracks 40 cooperate to prevent further retraction of the barrel 16 and the end of the spear extending beyond the barrel 16 is full of trash. The operator then directs the outer ends 30 and 50 of the spear 14 and barrel 16 toward a trash receptacle 58 (FIG. 4). It is not necessary that the ends 30 and 50 of the spear 14 and barrel 16 be directly in the mouth of the trash receptacle 58, but they can be somewhat removed therefrom. The finger-grip portion 44 of the trigger 20 is then squeezed by the operator's index finger to overcome the bias of the trigger spring 22 and thereby release the pawl member 46 from all teeth 48 of the ratchet mechanism of the barrel 16. At this time, the loaded barrel spring 18 sharply shoves the barrel 16 outwardly and the outer end 50 of the barrel and the outer edge of the plastic grommet 52 sharply drive the trash from the end 30 of the spear 14. This trash is literally "shot" from the end of the litter gun into the trash receptacle 58. The distance the trash 60 can be shot from the end of the litter gun depends to some extent upon the type of trash involved. For example, an orange peel, which is relatively heavy, can be shot further than tissue paper. It should again be noted that the trash is "shot" from the litter gun by use of only one hand of the operator with an easy, pistol-firing manipulation. Thus, the operator cocks the litter gun to a desired degree, uses it for spearing trash, and shoots the litter from the gun all with the use of only one hand.

The trigger mechanism 20 is stamped from sheet metal. The plastic handle can be vacuum formed into right and left halves and then solvent welded, or screwed, together.

It can be appreciated by those skilled in the art that the litter gun described herein is easy and inexpensive to construct and is effective to use. Not only this, but the pistol-like "shooting" aspect of the litter gun provides an element of fun in its use. Further, the litter gun can be fully operated with very little physical effort on various types of ground surfaces.

While the invention has been particularly shown and described with reference to a preferred embodiment, it will be understood by those skilled in the art that various changes in form and detail may be made therein without departing from the spirit and scope of the invention. For example, the handle can be made of right and left equal halves or it can be molded from one piece. Further, rather than a stop pin 36 extending through the barrel 16, the barrel 16 can have a protrusion molded on the top or side thereof with only a single guide cavity for receiving the protrusion. Still further, the tooth and pawl mechanism could be replaced by a friction grip or another type ratchet and pawl mechanism.

The embodiment in which an exclusive property or privilege are claimed are defined as follows:

1. A litter gun for spearing trash on a spear and thereafter shooting said trash from said spear in response to manual activation of a trigger on said litter gun, said litter gun comprising:

a handle including handgrip for allowing an operator to grip said litter gun with one hand during operation thereof;

an elongated spear having one end portion thereof fixedly attached to said handle with its other end portion extending outwardly away from said handle;

a tubularly-shaped barrel surrounding said elongated spear and being slidably engaged with said handle whereby said barrel has freedom of longitudinal movement relative to said handle and said spear;

a biasing means mounted between said handle and said barrel tending to shove said barrel outwardly, away from said handle toward said other end of said spear;

means for retaining said barrel in engagement with said handle but allowing freedom of longitudinal movement within a range of movement;

a trigger means mounted on said handle for engaging said barrel at a plurality of positions longitudinally located along the length of said barrel for allowing inward longitudinal movement of said barrel relative to said trigger means but engaging said barrel at said plurality of positions for preventing outward longitudinal movement of said barrel;

whereby said litter gun can be manipulated with said one hand so that said spear is driven through a first piece of trash lying on a relatively hard ground surface and as this is done the first piece of trash and said hard ground forces said barrel into said handle only a short distance where it is held by engagement of said trigger means, with said barrel at a first position therealong, with said spear penetrating said ground only a short distance, said litter gun can then be manipulated with said one hand so that said spear is driven through an additional piece of trash lying on said relatively hard surface and as this is done said first piece of trash and said hard ground forces said barrel into said handle an additional short distance where it is held by engagement of said trigger means with said barrel at a second position therealong, with said spear penetrating said ground only a short distance, and said pieces of trash can then be shot from said litter gun by activating said trigger with said one hand to release said barrel to thereby allow said biasing means to sharply shove said barrel which in turn shoves said trash toward the end of said spear, shooting said trash from said spear.

2. A litter gun as in claim 1 wherein said trigger means includes a pawl which engages a ratchet bar with teeth thereon mounted on said barrel which allows sliding engagement between said trigger mechanism and said barrel when said barrel is moved inwardly, but which provides a holding engagement between said trigger mechanism and said barrel by said pawl engaging teeth in said ratchet bar for preventing outward movement of said barrel unless said trigger mechanism is actuated to lift said pawl out of engagement with said ratchet bar teeth.

3. A litter gun as in claim 2 wherein said ratchet bar includes a series of finely graduated teeth located along said barrel.

4. A litter gun as in claim 1 wherein said barrel extends to the outer end of said spear when said barrel is in its fully extended position.

5. A litter gun as in claim 2 wherein a pin extends through said barrel and rides in guide tracks of said handle for maintaining a specific rotative attitude of said barrel during its longitudinal movement to ensure engagement between said pawl and said ratchet-bar teeth.

6. A litter gun as in claim 1 wherein said handle has a pistol shape such that said handgrip is a pistol-type handgrip with the trigger mechanism being actuated by the index finger of said one hand in the manner of a normal pistol, said barrel extending into a cavity of said handle.

* * * * *